US008484897B2

(12) United States Patent
Hsieh

(10) Patent No.: US 8,484,897 B2
(45) Date of Patent: Jul. 16, 2013

(54) DOOR OPERATOR OF FIREPROOF DOOR

(76) Inventor: Chung-Hsien Hsieh, Taipei Hsien (TW)

( * ) Notice: Subject to any disclaimer, the term of this patent is extended or adjusted under 35 U.S.C. 154(b) by 296 days.

(21) Appl. No.: 12/805,350

(22) Filed: Jul. 27, 2010

(65) Prior Publication Data

US 2012/0024484 A1 Feb. 2, 2012

(51) Int. Cl.
*E05F 15/20* (2006.01)

(52) U.S. Cl.
USPC ..... 49/199; 49/339; 49/360; 160/2; 160/8; 160/9

(58) Field of Classification Search
USPC ..... 49/197, 199, 324, 339, 360; 160/2, 160/6, 8, 9, 298; 74/625; 192/84.9, 84.95–84.961, 226; 188/156–164, 171
See application file for complete search history.

(56) References Cited

U.S. PATENT DOCUMENTS 4,372,432 A * 2/1983 Waine et al. ..... 192/223.4
5,203,392 A 4/1993 Shea
5,245,879 A 9/1993 McKeon
5,355,927 A 10/1994 McKeon
5,361,822 A * 11/1994 Nijs ..... 160/321
5,386,891 A 2/1995 Shea
5,507,374 A * 4/1996 Rude ..... 192/223.4
5,605,185 A 2/1997 McKeon
5,673,514 A 10/1997 McKeon
5,839,555 A * 11/1998 Hsieh ..... 192/223.1
5,893,234 A 4/1999 McKeon
6,055,885 A * 5/2000 Shea ..... 74/625
6,164,428 A * 12/2000 Berman et al. ..... 192/223.4
6,553,716 B2 * 4/2003 Bruns ..... 49/322
6,685,592 B2 * 2/2004 Fraczek et al. ..... 475/14
7,055,283 B2 * 6/2006 Hsieh ..... 49/139
7,275,631 B2 * 10/2007 Hsieh ..... 192/226
2006/0124250 A1 * 6/2006 Hsieh ..... 160/9

* cited by examiner

*Primary Examiner* — Katherine Mitchell
*Assistant Examiner* — Marcus Menezes
(74) *Attorney, Agent, or Firm* — Bacon & Thomas, PLLC

(57) ABSTRACT

A door operator of the fireproof door comprises a force applying end for releasing the reel of a door curtain, and a loading end for sustaining the weight of the door curtain. The rotary shaft comprises an internal (central) shaft and a plurality of external shaft coupled to each other via a clutch mechanism. The force applying end and the loading end act on the internal shaft and the external shaft respectively. A torsion spring brake mechanism is provided to resist the potential energy of the loading end by varying the inner diameter of the torsion spring so as to constantly restrain the rotary shaft from rotating, or to release the rotary shaft when the brake mechanism is subjected to an external force from the force applying end.

7 Claims, 7 Drawing Sheets

Figure 1A:
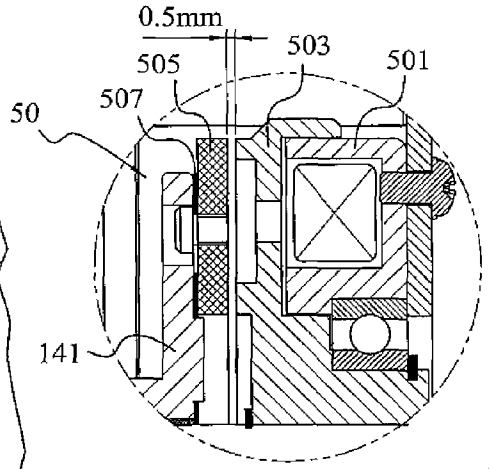

1
10
10'
12
14
16
18
20
30
40
50
60
161
201
201a
203
205
2031
2051
a
b
1i

DOOR OPERATOR OF FIREPROOF DOOR

BACKGROUND OF THE INVENTION

1. Field of the Invention

This invention relates to a door operator, more particularly to a door operator for a fireproof door.

2. Brief Description of Prior Art

Generally, the door operator used in a fireproof door is classified into two types depending on its operational mode: one is a failsafe mode and the other is a non-failsafe mode. In the case of the failsafe mode, a brake is immediately released by a brake device so as to shut the fireproof door in the absence of electrical power regardless of the reason of power failure. If fire breaks out in the presence of electrical power, the power is cut off by, for example, smoke detectors, temperature sensors or other fire detecting devices, or is cut off mechanically by a fusible link device which is molten at a high temperature in the fire in such a manner that the brake is released, and the door curtain shuts the fireproof door by its own weight. In this mode, the flame or escape of dense smoke can be blocked instantly when the fire occurs, if the cause of power failure is a fire indeed. Therefore, the main feature of the failsafe mode is more active for fire prevention. However, if the cause of the power failure is not a fire, a manually operating means has to be used for driving the door operator to open the door so as to maintain regular access for personnel.

On the other hand, in non-failsafe mode, the brake device is still maintained in a brake-actuated state without closing the fireproof door immediately in the absence of electrical power, regardless of the reason of power failure. Only if the occurrence of a fire is definitely confirmed by, for example, smoke detectors, temperature sensors or other fire detecting devices, a current transiently supplied from a reserved power source such as a capacitor, a battery or the like is supplied to the brake device for releasing the brake for a short period of time, or a fusible link is molten at a high temperature for mechanically actuating the brake device so as to release the brake, in such a manner that the door curtain falls down and shuts the fireproof door by its own weight. In this mode, the main advantage is that no inconvenience is encountered for personnel regular access is the main advantage, if the fire is not the cause of power failure. However, if the power failure is caused by a fire, and if the fire point is remote from the fire detecting devices or the fusible link, it is impossible to close the fireproof door immediately. Therefore, this mode is less safe for fire prevention.

Some documents associated with a failsafe mode door operator of a fireproof door have been proposed, such as U.S. Pat. Nos. 5,673,514 and 5,893,234 in which two electromagnets are used to maintain the brake-actuating state in the presence of electrical power, or to release the brake immediately so as to close the fireproof door in a power failure condition. The structure thereof is very complicated and has a large volume. On the other hand, a lot of documents concerning non-failsafe mode door operator of fireproof door such as U.S. Pat. Nos. 5,203,392 and 5,386,891 are disclosed, in which manual operation has to be conducted by switching operation mode, or a chain disk is rotated by pulling an endless chain and meanwhile the brake is released so as to rotate the rotary shaft. Thus, there is still room for further improvements on the implementation and the structure of a door operator.

SUMMARY OF THE INVENTION

The main object of the present invention is to provide a novel door operator of a fireproof door capable of obviating the disadvantages such as complexity in structure, large volume and inconvenience in operation present in prior art.

In order to achieve the aforementioned and the other objects, the door operator of the fireproof door according to the present invention comprises: a force applying end, which is activated to drive a rotary shaft; and a loading end for supporting the weight of the door curtain, the rotary shaft comprising an internal shaft and an external shaft. The force applying end and the loading end are applied on the internal shaft and the external shaft respectively, and the internal shaft and the external shaft are normally coupled by a clutch mechanism. A torsion spring brake mechanism is used to normally brake or release the rotary shaft by reducing or enlarging the inner diameter of the torsion spring. When an external force is exerted on the force applying end in a manner that the torsion spring is de-twisted or its inner diameter is enlarged, the rotary shaft is released and rotated. In the case that no external force is exerted thereto, the loading from the weight of the door curtain is normally transferred to the torsion spring so that the torsion spring is twisted or its inner diameter is reduced, whereby braking the rotary shaft. In this way, the clutch mechanism is controlled to interrupt the coupling of the internal shaft and the external shaft such that the door curtain falls and shuts the fireproof door in the event of a fire alarm. Thus, flame or smoke can be blocked immediately.

According to the present invention, each end of the torsion spring is provided with a protrusion loop having a twisting side and a de-twisting side. The external force exerted from the force applying end is applied on the de-twisting side so that the torsion spring is de-twisted or its inner diameter is enlarged and the rotary shaft is released and rotated by the external force. Alternatively, the loading on the loading end from the weight of the door curtain is applied on the twisting side so that the torsion spring is twisted or its inner diameter is reduced to brake the rotation of the rotary shaft caused by the weight of the door curtain. With aid of the torsion spring brake mechanism, not only is the external force allowed to roll up or down the door curtain, but also the rotation of the rotary shaft caused by the weight of the door curtain is braked.

According to the present invention, the rotary shaft of the door operator is simplified and compact in structure by arranging the internal shaft in the external shaft.

According to the present invention, the door operator of the fireproof door can be adapted to a failsafe door operator by introducing an electromagnetic clutch or into a non-failsafe door operator by introducing a mechanical clutch. Most of the components used in both cases are the same. Not only lower manufacturing cost, fewer components and simplicity in production can be achieved, but also smaller inventory and simplicity in assembly can be realized.

According to the present invention, the door operator of the fireproof door further has a circuit by which the electromagnetic clutch can be excited in the presence of a normal power supply. The circuit may further include a delay circuit formed by a plurality of capacitors, which are charged in the presence of the normal power supply. In the event of a power interruption caused by a fire, the electromagnetic clutch can be excited for a short time excitation so as to delay shutting of the fireproof door for the personnel evacuation.

BRIEF DESCRIPTION OF ACCOMPANYING DRAWINGS

Figure 1B:
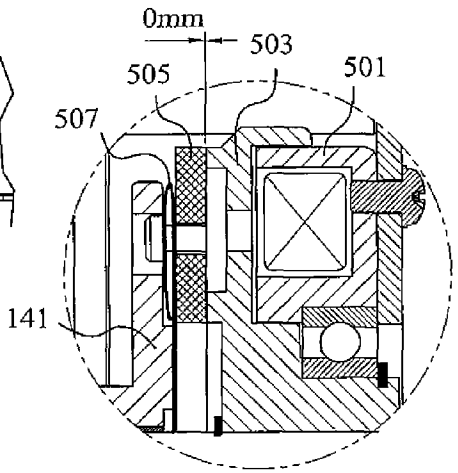
Figure 1:
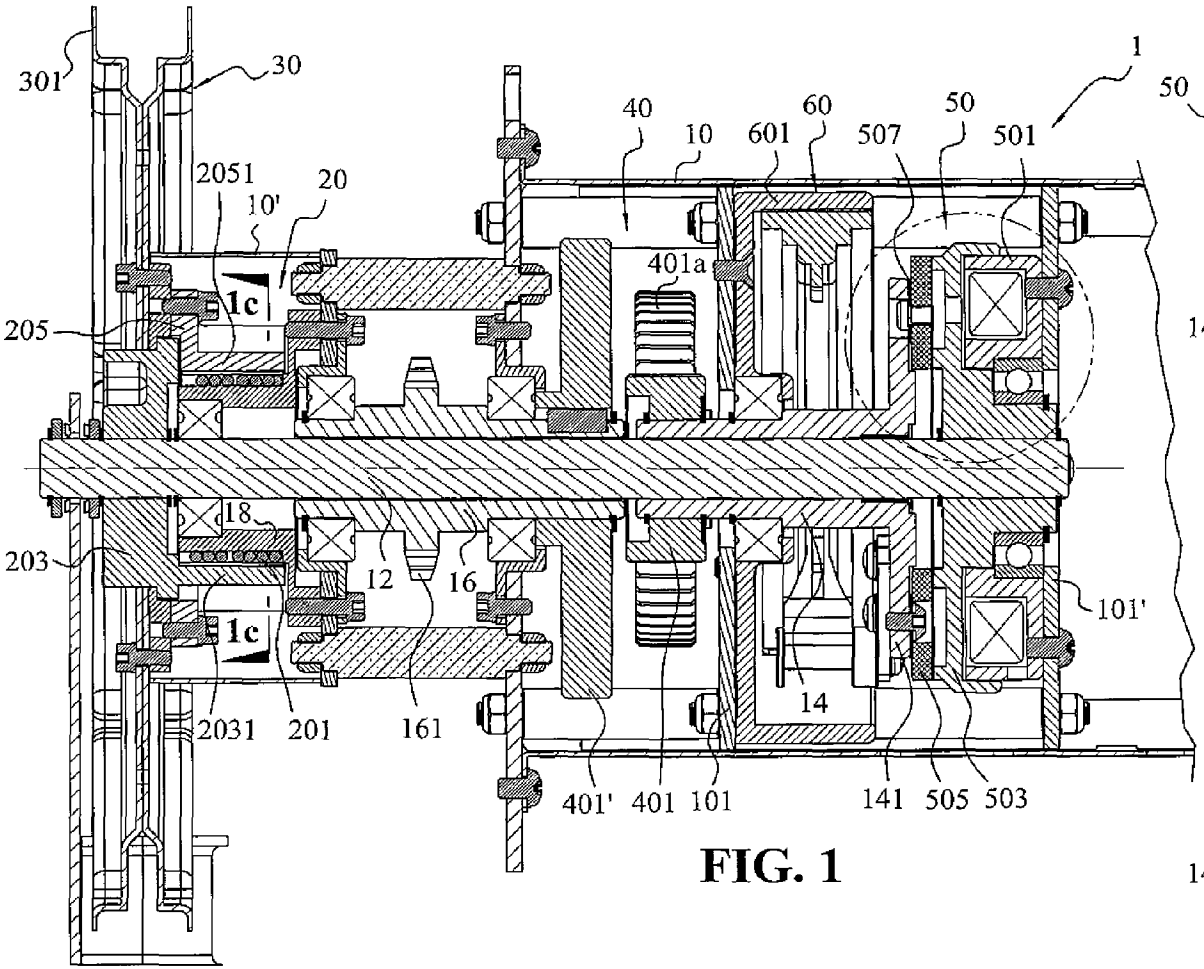

FIG. 1 is a sectional view showing the door operator of a failsafe type fireproof door according to the present invention.

FIG. 1*a* is a partially enlarged view of the encircled portion in FIG. 1 in which the clutch mechanism is shown to be in a separated state.

FIG. 1*b* is a partially enlarged view of the encircled portion in FIG. 1 in which the clutch mechanism is shown to be in an engaged state.

Figures 1C, 1D, 1E, 1F:
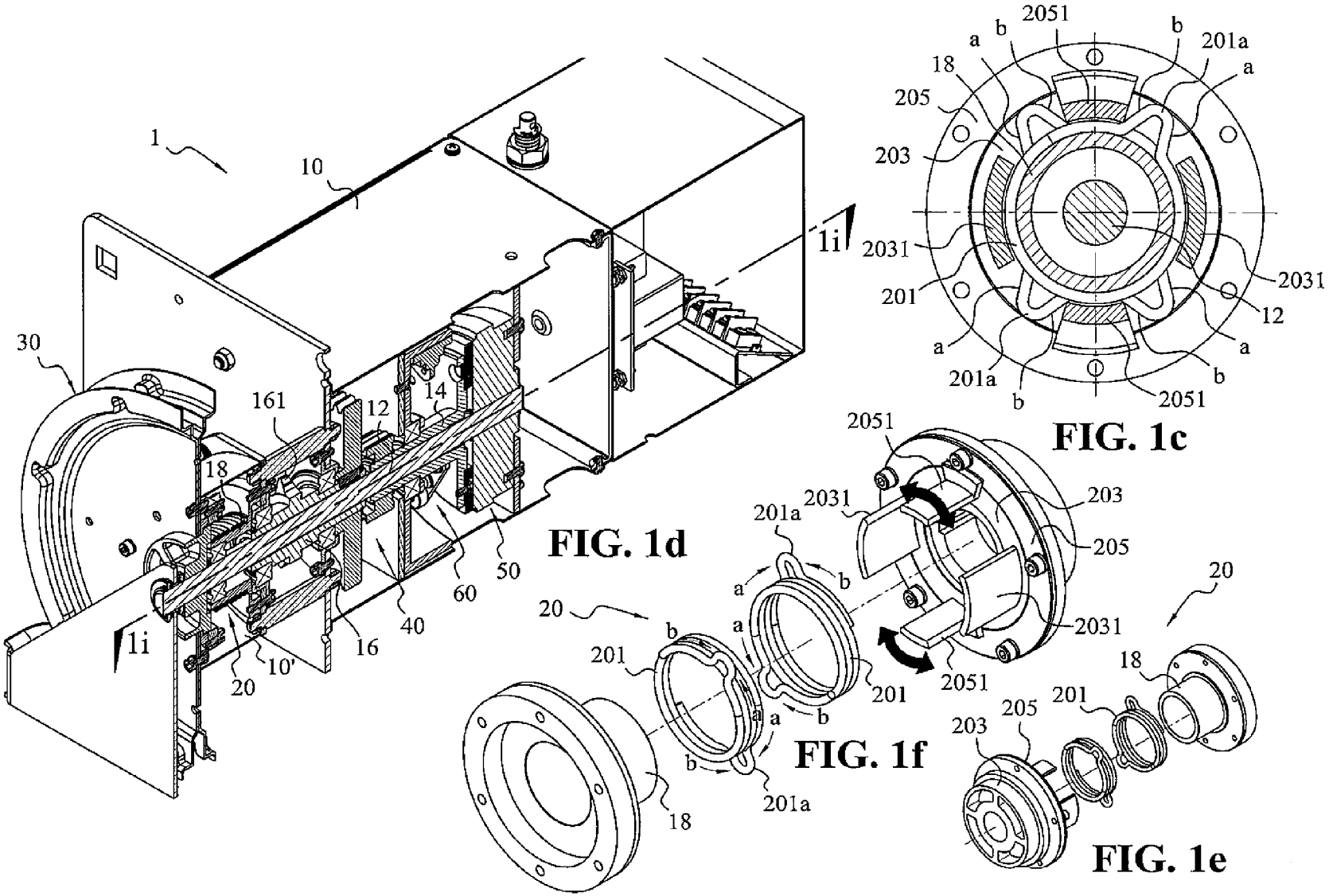

FIG. 1*c* is a sectional schematic view taken along the line 1*c*-1*c* of FIG. 1.

FIG. 1*d* is a perspective sectional view showing the door operator of FIG. 1.

FIG. 1*e* is an exploded perspective view showing the torsion spring brake mechanism of the present invention.

FIG. 1*f* is an exploded perspective enlarged view in another direction showing the torsion spring brake mechanism in FIG. 1*e* of the present invention.

Figure 1G:
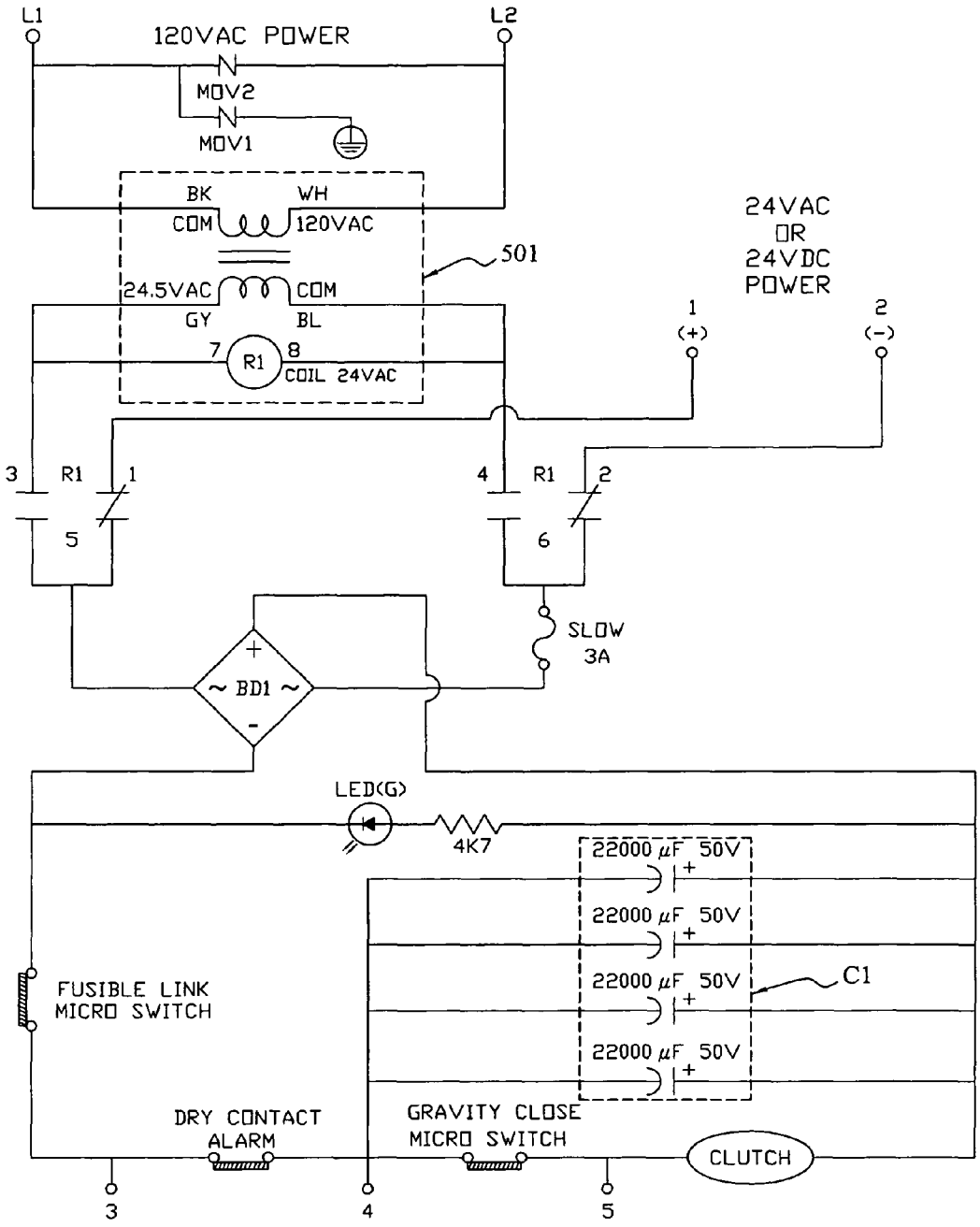

FIG. 1*g* is a schematic view showing a circuit used in the door operator of a failsafe type fireproof door according to the present invention.

Figure 1H:
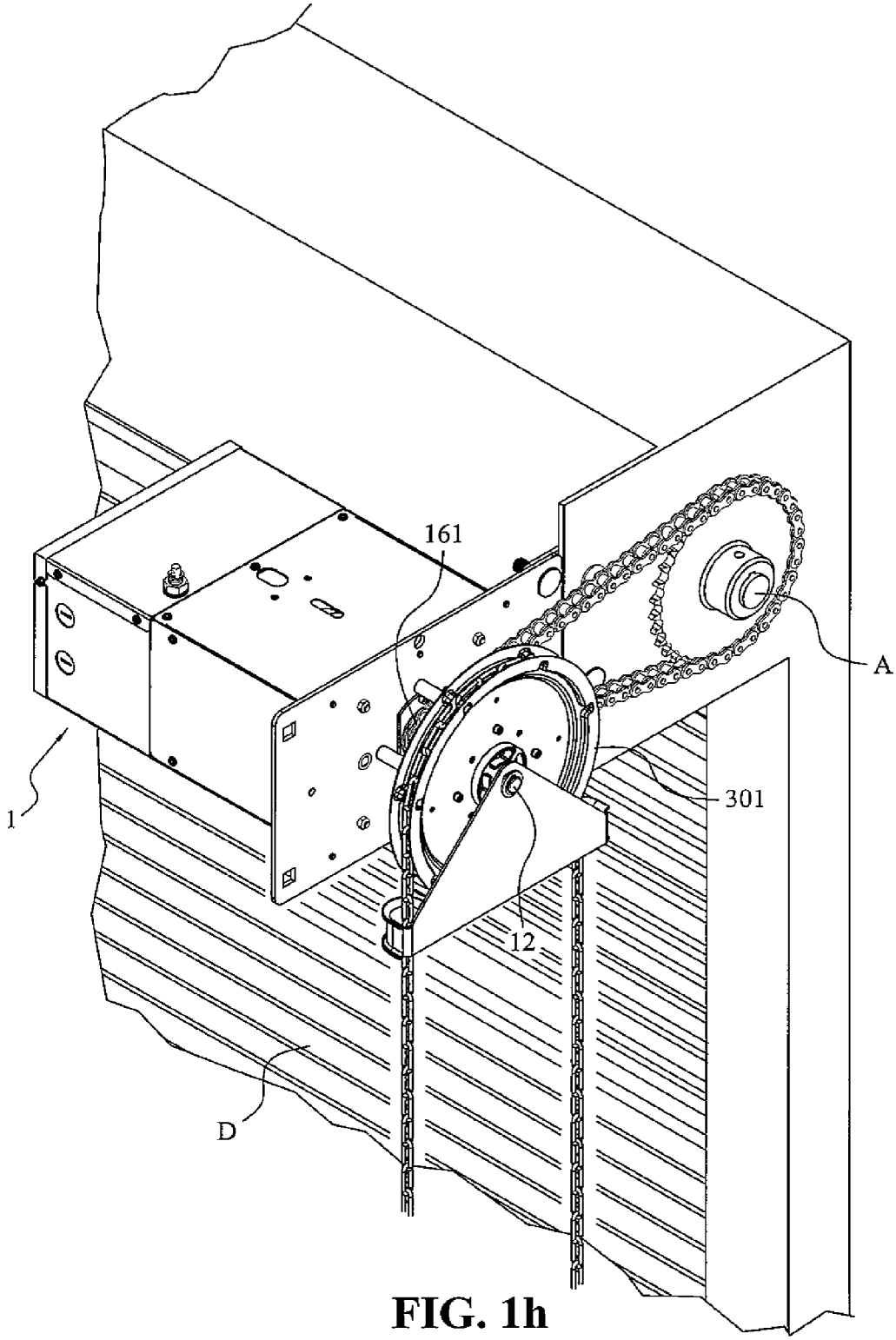

FIG. 1*h* is a schematic drawing showing the state of use of the present invention.

Figure 1I:
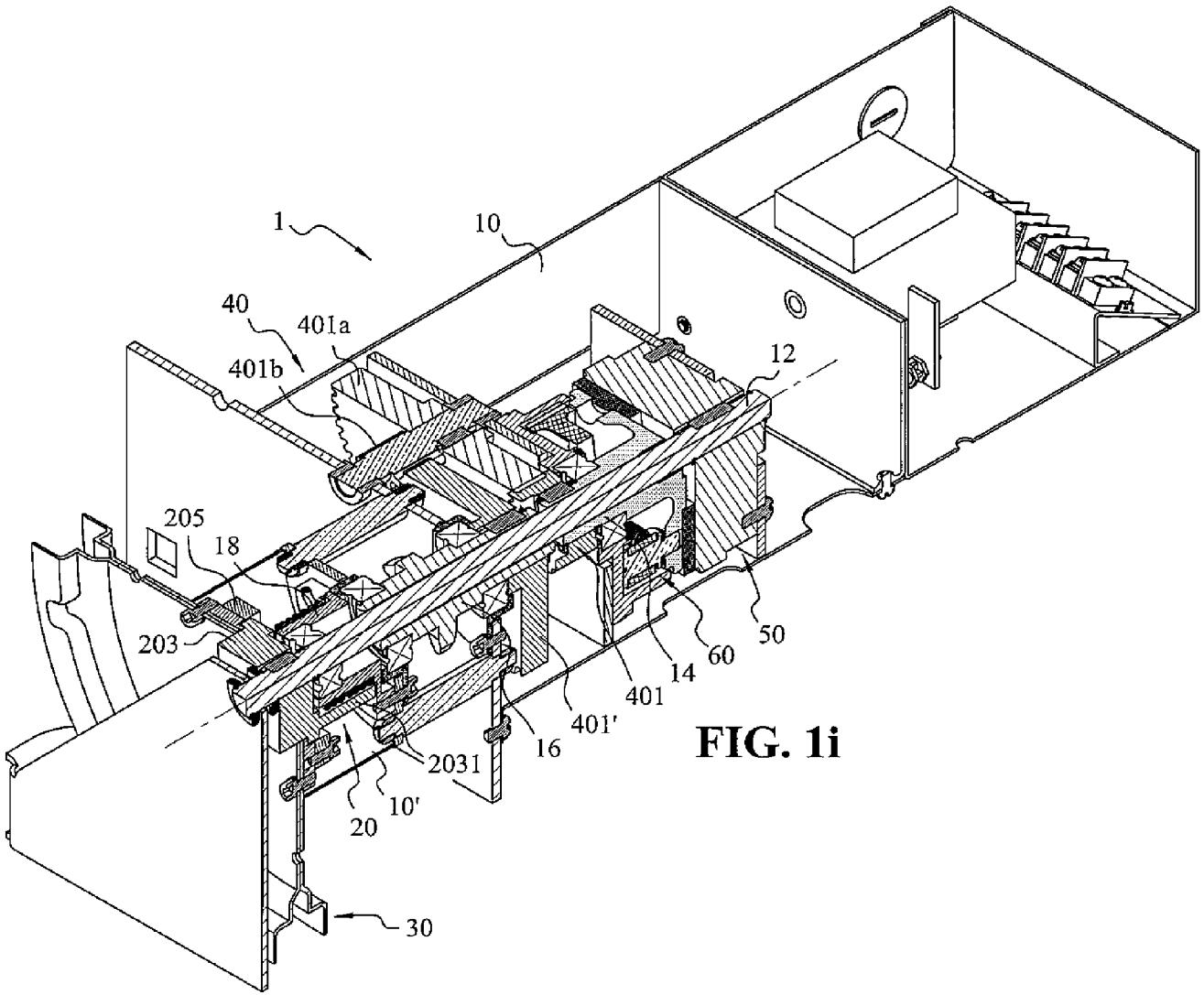

FIG. 1*i* is a sectional view taken along the line 1*i*-1*i* in FIG. 1*d*.

Figures 2, 2A:
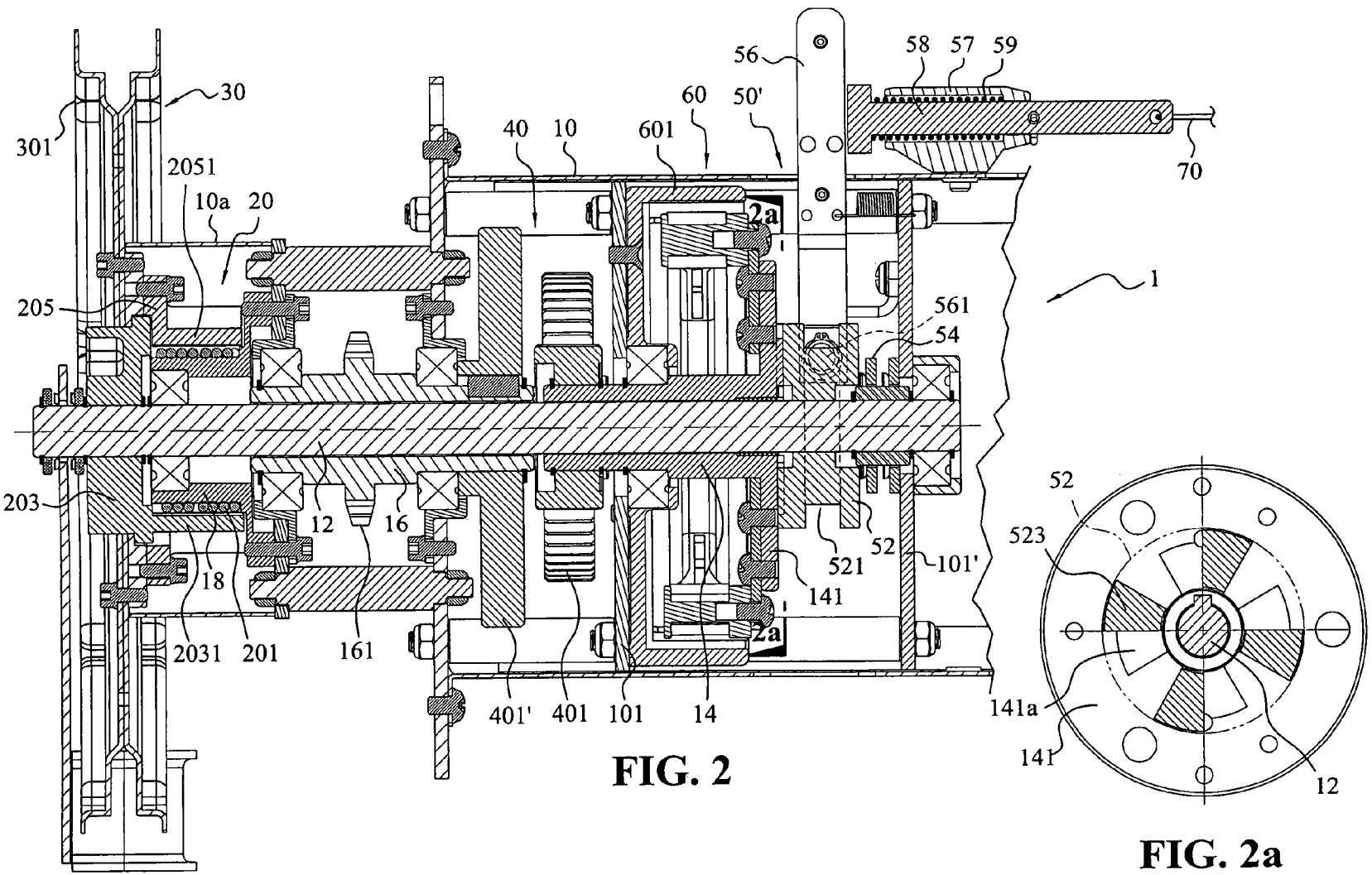

FIG. 2 is a sectional view showing an embodiment of a non-failsafe type door operator of fireproof door of the present invention.

FIG. 2*a* is a schematic sectional view taken along the line 2*a*-2*a* in FIG. 2.

Figure 2B:
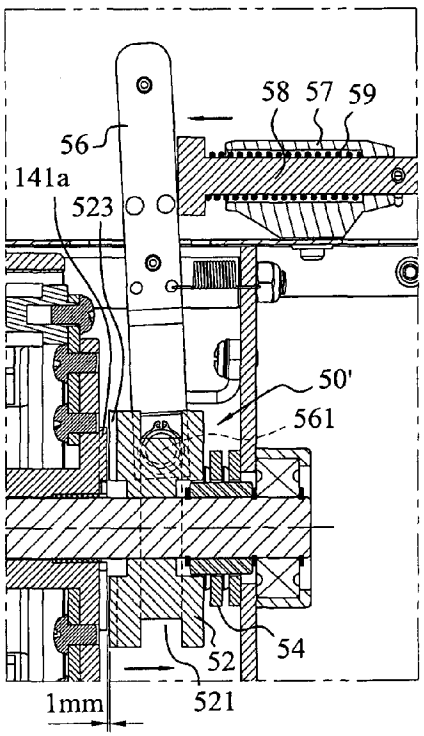

FIG. 2*b* is a dynamic schematic view of the clutch mechanism in FIG. 2 in which the clutch mechanism is shown to be in separated state.

Figure 2C:
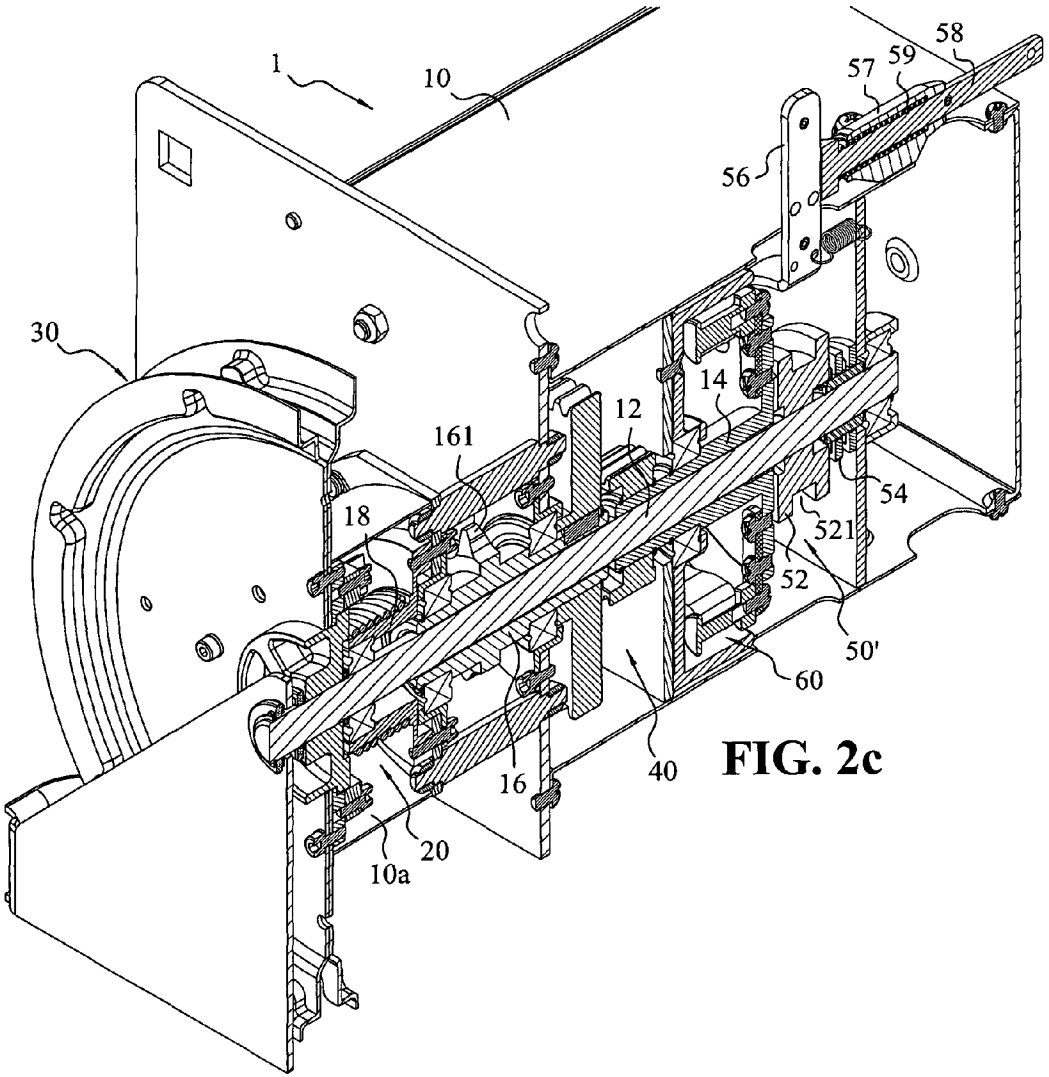

FIG. 2*c* is a sectional perspective view showing the door operator in FIG. 2.

DETAILED DESCRIPTION OF PREFERRED EMBODIMENTS

The technical contents of the present invention will become more apparent from the detailed description of the preferred embodiments in conjunction with the accompanying drawings. It is noted that the preferred embodiments which are purely illustrative do not intend to restrict the implementation range of the present invention.

Firstly referring to FIGS. 1, 1*a* to 1*i*, an embodiment of a failsafe type door operator of a fireproof door of the present invention is described. The door operator 1 of the present invention is used to release a reel A of a door curtain D so as to close the fireproof door in the event of power failure. The door curtain is composed of a plurality of slats. The door operator 1 essentially comprises a housing 10 defining an accommodation space. A central shaft 12 is rotatably arranged in the housing 10. A torsion spring brake mechanism 20 is arranged to encircle around the circumference at the left end of the central shaft 12 for braking or releasing the central axis 12 by twisting or de-twisting one or more torsion springs 201 of the torsion spring brake mechanism 20. The details of the torsion spring brake mechanism 20 will be described later. A drive mechanism 30 is disposed on the central shaft 12 in such a manner that the torsion springs 201 is de-twisted to the effect that the inner diameter thereof is enlarged when an external force is exerted on the drive mechanism 30 whereby releasing and rotating the central shaft 12. A first external shaft 14 is rotatably mounted on the central shaft 12. A clutch mechanism 50 is disposed on the central shaft 12 at the right end of the first external shaft 14 for connecting and disconnecting the central shaft 12 and the first external shaft 14 in a control manner. A second external shaft 16 adjacent to the left end of the first external shaft 14 is rotatably mounted on the central shaft 12 and firmly provided with an output pulley 161 which is coupled with the reel A of the door curtain D (as shown in FIG. 1*h*). A reduction mechanism 40 includes gear trains 401, 401'. As shown in FIG. 1*i*, a first external shaft 14 is coupled to a second external shaft 16 through gear 401, gear 401*a*, gear 401*b* and gear 401' in sequence so as to reduce the speed of the first external shaft 14, and transfer the reduced speed to the second external shaft 16. When no external force is exerted on the drive mechanism 30, the loading from the weight of the door curtain is normally transmitted to the torsion spring 201 through the output pulley 161, the second external shaft 16, the reduction mechanism 40, the first external shaft 14, the clutch mechanism 50 and the central shaft 12 so that the torsion springs 201 are twisted to the effect that the inner diameter thereof is reduced, whereby braking and holding the central shaft 12. In the event of the fire alarm and power failure, the clutch disconnects the first external shaft 14 from the central shaft 12 such that the door curtain falls down by its own weight and shuts the fireproof door.

According to the present invention, a centrifugal brake mechanism 60, which is well known, is arranged to encircle the outer circumference of the first external shaft 14 for limiting the rotation speed of the first external shaft 14 by a friction on the brake drum caused by a centrifugal force. The centrifugal force is generated when the first external shaft 14 rotates. The housing 10 is partitioned into a plurality of spaces by a plurality of partitioning plates 101, 101'. The brake drum 601 is fixed on one of the partitioning plates 101. One end of the first external shaft 14 is rotatably and is centrally aligned with the brake drum 601, while the other end is provided with a driven disc 141.

The clutch mechanism 50 is located on the opposite side of the driven disc 141 which comprises an electromagnet 501 fixed on the other one of the partitioning plates 101' of the housing 10. A drive member 503 has an end face adjacent to the electromagnet 501 and is fixed on the central shaft 12. A follower 505 which is provided with a brake shoe 533 and interposed between the drive member 503 and the driven disc 141 is biased by an elastic plate 507 and is coupled with the driven disc 141. When the electromagnet 501 is not excited, the follower 505 is biased toward the driven disc 141, as shown in FIG. 1*a*. At the same time, the coupling of the central shaft 12 and the first external shaft 14 is disconnected. On the other hand, when the electromagnet 501 is excited, the follower 505 is pushed toward the drive member 503 by the electromagnet 501 against the elastic plate 507, as shown in FIG. 1*b*. In the same time, the central shaft 12 and the first external shaft 14 are coupled. Moreover, a circuit is provided to excite the electromagnet 501 in the presence of the normal power supply, so that the central shaft 12 and the first external shaft 14 are normally coupled.

Furthermore, the housing 10 is provided with a second housing 10' for supporting one end of the second external shaft 16, and the torsion spring brake mechanism 20 is received in the second housing 10'. The torsion spring brake mechanism 20 is provided with a hub 18 which rotatably supports one end of the central shaft 12. One end of the hub 18 is fixed on the second housing 10'. As shown in FIGS. 1*e* and 1*f*, the torsion spring brake mechanism 20 has one or more torsion springs 201. Two ends of each torsion spring 201 are free ends. Each torsion spring 201 constricts the circumference of the other end of the hub 18. Each free end of each torsion spring 201 is formed with a protrusion loop 201*a*. An inner ring portion 203 and an outer ring portion 205 are concentric and rotatable with respect to each other. The inner ring portion 203 is fitted and fixed on the central shaft 12. A pair of blocking plates 2031 are erected on one top face of the inner ring portion 203 in the longitudinal direction and arranged opposite to each other in the radial direction. A pair of push-plates 2051 are erected on one top face of the outer ring portion 205 at the same side with the blocking plates 2031 and arranged opposite to each other in the radial direction in such a matter that the blocking plates 2031 and the push-plates 2051 are disposed alternately around the torsion springs 201. The blocking plates 2031 and the push-plates 2051 are concentric and arranged at the same radius. The protrusion loop 201*a* is received in a gap between one blocking plate 2031 and one push-plate 2051 which are adjacent to each other. Each protrusion loop 201*a* has a twisting side a and a de-twisting side b. The "twisting side" refers to as the side on which a force is exerted, causing the torsion to be twisted. The "de-twisting side" refers to as the side on which a force is exerted, causing the torsion to be de-twisted. The blocking plates 2031 are respectively arranged between two twisting sides a and would be blocked by the twisting sides a. Rotation of the outer ring portion 205 causes the push-plates 2051 to be abutted on the de-twisting sides b and hence causes the torsion springs 201 to be de-twisted as shown in FIG. 1*c* so that the rotation of the outer ring portion 205 is kept going. In addition, the drive mechanism 30 includes a chain wheel 301 and a chain wound on the outer circumference of the chain wheel 301. The chain wheel 301 is fixed on the outer ring portion 205.

The central shaft 12 can be indirectly rotated by pulling the chain.

Referring to FIGS. 1 and 1*g*, the coil R1 of the electromagnet 501 of the clutch mechanism 50 is excited in the presence of the normal power supply such that the central shaft 12 and the first external shaft 14 are coupled with each other normally. At this moment, if the chain is pulled, then the push-plates 2051 are rotated and abutted on the de-twisting sides b of the protrusion loops 201*a* of the torsion springs 201 so that the torsion springs 201 are subject to a de-twisting torque and hence de-twisted. The inner diameter of the torsion springs 201 is enlarged and the hub 18 is released from the torsion springs 201. Then, the torsion springs 201 are rotated along the circumference of the hub 18, so the blocking plates 2031 on the other side of the protrusion loops 201*a* are also rotated together. The drive force applied on the central shaft 12 is transferred through the first external shaft 14 and the second external shaft 16 to the reel of the door curtain so as to roll up or down the door curtain. On the other hand, if the drive mechanism 30 is not operated, the loading of the weight of the door curtain on the output pulley 161 is transferred to the central shaft 12 through the first external shaft 14 and the second external shaft 16. In such a case, the blocking plates 2031 of the inner outer portion 203 are abutted on the twisting sides a of the protrusion loops 201*a* of the torsion springs 201 so that a twisting torque is applied to the torsion springs 201 and the torsion springs 201 are further twisted. As the torsion springs 201 are further twisted, the torsion springs 201 constrict on the hub 18 more firmly and hence become unmovable and unrotatable about the hub 18. As a result, the blocking plates 2031 are blocked by the unmovable and unrotatable torsion springs 201, and hence the central shaft 12 is braked and held.

In the event of power failure, the clutch mechanism 50 immediately interrupts the coupling of the central shaft 12 and the first external shaft 14 such that the door curtain falls down by its own weight. Even when fire breaks out in the presence of the power supply, the power supply can be interrupted by conventional fire detecting devices, for example, smoke detectors, temperature sensors or other fire detecting devices. Furthermore, a delay circuit C1 formed by a plurality of capacitors may be included in the circuit. The capacitors which are charged in the presence of the power supply supply a current to the coil R1 of the electromagnet 501 for a short time in the event of the power failure the electromagnet 501 is excited transiently, for example for about 10 seconds, so as to delay the shutting of the fireproof door for immediate personnel evacuation.

Furthermore, FIGS. 2 to 2*c* illustrate an embodiment of a non-failsafe door operator of a fireproof door of the present invention. This embodiment different from the preceding one in that a mechanical type of clutch mechanism 50' is included to couple the central shaft 12 and the first external shaft 14 or disconnect them from each other. According to this invention, the other end of the central shaft 12 is rotatably support on the other partitioning plate 101' at the outer side of the partitioning plate 101'. The clutch mechanism 50' has a bushing 52 disposed on the right side of the driven disc 141. The bushing 52 is arranged in such a manner that the bushing 52 can slide axially therein and rotate together with the central shaft 12, but cannot rotate with respect to the central shaft 12. A circumferential sliding groove 521 is formed along the outer circumference of the bushing 52. A disk spring 54 is interposed between the bushing 52 and the partitioning plate 101'. One end of the bushing 52 is biased by the disk spring 54 such that the other end thereof is normally abutted against the driven disk 141. A first teeth portion 141*a* is formed on the end face of the driven disk 141 which is to be engaged with a second teeth portion 523 formed on the end face of the other end of the bushing 52, as shown in FIGS. 2 and 2*a*.

According to the present invention, a rocking lever 56 is provided. The middle portion of the rock lever 56 is pivoted on the housing 10. The inner end of the rocking lever 56 is provided with a protruding pin 561 extending into the sliding groove 521. The outside end of the rocking lever 56 extends outside of the housing 10. A guide member 57 is fixed on the housing 10 corresponding to the outer end of the rocking lever 56. A slider 58 inserted in the guide member 57 is slidably guided in the guide member 57. The slider 58 is biased by an elastic element 59 and connected with a conventional fire detecting device 70. The slider 58 is arranged in place so that the outer end of the rocking lever 56 can be operated by one end of the slider 58. The slider 58 is held by the fire detecting device 70 so that the slider 58 is not abutted to the rocking lever 504. The fire detecting device 70 may be a smoke detector, temperature sensor or other fire detecting device, preferably a fusible link which is molten and broken at a temperature exceeding its melting point so that the slider 58 is released and hits the outer end of the rocking lever 56 and swings the inner end of the rocking lever 56. Due to the projecting pin 561 extending into the sliding groove 521, the bushing 52 is axially moved by the projecting pin 561 against so as to resist the disk spring 54 such that the bushing 52 is separated from the driven disc 141. As a result, the coupling of the central shaft 12 and the first external shaft 14 is disconnected.

According to the present invention, the door operator can be modified into a failsafe door operator or a non-failsafe door operator easily. The most of components for the door operator can be applied to either the failsafe one or the non-failsafe one. Therefore, not only low manufacturing cost, fewer components and simplicity in production can be achieved, but also smaller inventory and easy replacement can be realized.

While the preferred embodiments have been described as above, it is noted that the preferred embodiments are not intended to restrict the scope of implementation of the present invention. Modifications and variations can be made without departing from the spirit and scope of the claims of the present invention.

What is claimed is:

1. A door operator of a fireproof door for releasing a reel of a door curtain in an event of a fire accident, said door operator comprising:

a housing defining an interior space;

a central shaft pivoted in said housing;

a torsion spring brake mechanism arranged around a circumference of a left end on said central shaft, said torsion spring brake mechanism including at least one torsion spring for controlling said central shaft to be either in brake-actuated state or in brake-release state;

a drive mechanism disposed on said central shaft for applying an external force;

a first external shaft mounted on and rotatable relative to said central shaft;

a clutch mechanism disposed on a right end of the first external shaft and fixed on said central shaft for engaging or disengaging said central shaft and said first external shaft in a control manner;

a second external shaft disposed on a left end of said first external shaft and rotatably mounted on said central shaft, an output pulley being fixed on the second external shaft for operating the reel of the door curtain;

a reduction mechanism being coupled to said first external shaft and said second external shaft by means of a plurality of gears for reducing the rotation speed transferred from said first external shaft to said second external shaft;

wherein in the presence of a power supply, the clutch mechanism is coupled to the central shaft and the first external shaft, and when the external force is applied by the drive mechanism, the central shaft actuates the torsion spring brake mechanism to radially expand the at least one torsion spring and the external force transfers through the central shaft, first external shaft, and second external shaft to roll the door curtain, and in the event of a power failure, said clutch mechanism disconnects said central shaft from said first external shaft to thereby release the reel such that the door curtain drops by gravity to close the fireproof door.

2. The door operator of the fireproof door as claimed in claim 1, further comprising a centrifugal brake mechanism arranged around an outer circumference of said first external shaft, said centrifugal brake mechanism being configured to reduce the rotation speed of said first external shaft by means of a centrifugal force produced by the rotation of said first external shaft and said centrifugal brake mechanism, and a friction force exerting on a brake drum.

3. The door operator of the fireproof door as claimed in claim 2, wherein said housing is partitioned by a plurality of partitioning plates into a plurality of cavities; said brake drum of said centrifugal brake mechanism is mounted on one of the partitioning plates; said first external shaft is pivotally connected to the center of said brake drum at one end thereof, and is provided with a driven disc on the other end thereof.

4. The door operator of the fireproof door as claimed in claim 3, wherein said torsion spring brake mechanism comprising:

a hub fixed on said housing for supporting said central shaft, one end of said hub being fixed on said housing;

at least one torsion spring with two free ends, each free end of said at least one torsion spring is formed into a protrusion loop, each torsion spring being fitted on an outer circumference of the other end of the hub;

an inner ring portion and an outer ring portion concentric and rotatable with respect to each other, said inner ring portion being fitted and fixed on said central shaft;

a pair of blocking plates disposed on one top face of said inner ring portion in a longitudinal direction and arranged opposite to each other in a radial direction, and a pair of push-plates disposed on one top face of said outer ring portion at the same side with the blocking plates and arranged opposite to each other in the radial direction in such a manner that the blocking plates and the push-plates are disposed alternately around said at least one torsion spring; both said blocking plates and said push-plates are concentric and arranged at the same radius and said protrusion loop is received in a gap between one blocking plate and one push-plate which are adjacent to each other.

5. The door operator of the fireproof door as claimed in claim 4, wherein said clutch mechanism comprises: an electromagnet mounted on the other one of the partitioning plates of said housing; a drive member having an end face adjacent to said electromagnet and mounted on said central shaft; a follower with one end face having a brake shoe between said drive member and said driven disc, said follower being biased by an elastic plate and coupled with the driven disc.

6. The door operator of the fireproof door as claimed in claim 5, wherein the electromagnet is energized in the presence of a power supply.

7. The door operator of the fireproof door as claimed in claim 4, wherein said drive mechanism includes a chain wheel and a chain wound around said chain wheel, said chain wheel being mounted on said outer ring portion, whereby the torsion spring brake mechanism is actuated to rotate said central shaft by pulling said chain.

* * * * *